United States Patent [19]

Linebarger

[11] 4,396,428

[45] Aug. 2, 1983

[54] PROCESSES FOR PRODUCING AND CASTING DUCTILE AND COMPACTED GRAPHITE CAST IRONS

[75] Inventor: Henry F. Linebarger, Tonawanda, N.Y.

[73] Assignee: Elkem Metals Company, Niagara Falls, N.Y.

[21] Appl. No.: 362,867

[22] Filed: Mar. 29, 1982

[51] Int. Cl.[3] ..... C22C 33/08

[52] U.S. Cl. ..... 75/130 R; 75/130 A; 75/130 AB

[58] Field of Search ..... 75/130 R, 130 AB, 130 A

[56] References Cited

U.S. PATENT DOCUMENTS

| | | | |
|---|---|---|---|
| 2,821,473 | 1/1958 | Moore | 75/130 AB |
| 3,076,705 | 2/1963 | Yearley | 75/130 A |
| 3,113,019 | 12/1963 | Adams | 75/130 A |
| 3,421,887 | 1/1969 | Kusaka | 75/130 R |
| 3,955,973 | 5/1976 | Robinson | 75/130 A |

*Primary Examiner*—P. D. Rosenberg

*Attorney, Agent, or Firm*—Eyre, Mann, Lucas & Just

[57] ABSTRACT

The present invention is directed to processes and apparatus for carrying out said processes wherein molten cast iron is treated with a predominantly iron alloy having the essential elements by weight of from about 0.1 to about 10.0% silicon and about 0.5 to about 4.0% magnesium. The alloy may comprise from about 0.1 to about 10.0% silicon, about 0.5 to about 4.0% magnesium, up to about 2.0% of one or more rare earth elements such as cerium about 0.5 to about 6.5% carbon, the balance being iron. Small amounts of calcium, barium or strontium and trace elements customarily found in conventional raw material may be present in the alloy. The characteristics of the alloy make it possible to establish a ready supply of treated molten iron in the foundry in holding vessels with a selected chemical composition at a given temperature. It also makes possible semi-continuous and continuous casting of ductile and compacted graphite cast irons.

35 Claims, 7 Drawing Figures

PROCESSES FOR PRODUCING AND CASTING DUCTILE AND COMPACTED GRAPHITE CAST IRONS

The present invention is directed to processes and apparatus for carrying out the processes for treating ordinary molten cast iron to produce ductile or compacted graphite cast irons. The processes of the present invention are made possible by means of an iron alloy of low silicon and low magnesium content and density which approaches, and for best results at least equals or exceeds, the density of the molten iron to be treated.

The addition of magnesium to molten cast iron to cause precipitation of carbon as spheroidal graphite is well known. The resulting ductile cast iron has superior tensile strength and ductitility as compared to ordinary cast iron. The amount of magnesium retained in the cast iron for this purpose is from about 0.02 to about 0.08% by weight of iron.

Compacted graphite cast iron is also produced by incorporating magnesium into molten cast iron. The amount of magnesium retained in the cast iron for this purpose is much less and of the order of about 0.015% to about 0.035% magnesium based on the weight of iron. The magnesium causes the carbon in the cast iron to become more chunky and stubby but short of going over to the complete spheroidal form of ductile cast iron. Compacted graphite cast iron has improved tensile strength compared to gray iron and may possess greater resistance to thermal shock and greater thermal conductivity than ductile cast iron.

In the known processes for treating cast iron to form ductile or compacted graphite cast irons, difficulty is experienced when magnesium or an alloy with high magnesium content is used because of the fumes, smoke and flare that occur when magnesium or high magnesium alloy is added to the molten iron. As a result there is only a small percentage, about 25% by weight, of the added magnesium recovered in the iron in laboratory testing. The magnesium smoke and fumes leaving the bath cause an air pollution problem and the violent magnesium reaction tends to cause difficulty in control of the treatment process.

Ferrosilicon alloys containing 5% or more magnesium by weight also have the drawback of a high silicon content which reduces flexibility in the foundry with respect to using scrap since the silicon content in the final product must be maintained at an acceptable level to avoid impairing the impact characteristics of the final product. Magnesium-ferrosilicon alloys of high silicon content tend to float on the surface of the molten iron which further contributes to the loss of magnesium (see U.S. Pat. Nos. 3,177,071; 3,367,771; and 3,375,104).

Magnesium-nickel alloys have also been used but these have limited application to those cases where a high nickel cast iron is desired. Otherwise, the cost of nickel in the alloy makes it too expensive for general use in producing ordinary ductile and compacted graphite cast irons. (see U.S. Pat. Nos. 3,030,205; 3,544,312). The use of coke and charcoal briquettes impregnated with magnesium (U.S. Pat. Nos. 3,290,142; 4,309,216) has been suggested as well as compacted particulate metals (U.K. Pat. Nos. 1,397,600; 2,066,297). While these may assist somewhat in reducing loss of magnesium, special processing techniques are required for producing the specified structures and special handling techniques are required in the foundry.

Mechanical approaches have also been suggested wherein a magnesium composition is introduced or positioned below the surface of the molten iron bath (U.S. Pat. Nos. 2,896,857; 3,080,288; 3,157,492; 3,285,739; 4,147,533; 4,166,738; 4,261,740). While these mechanical approaches tend somewhat to inhibit pyrotechnics caused by the violent reaction or magnesium, substantial quantities of magnesium vapor still escape into the atmosphere and the added steps incident to a mechanical approach do not adequately compensate for the loss.

Another major drawback to the known prior art processes is that they are carried out as a single batch operation wherein the quantity of magnesium required for converting ordinary cast iron to ductile or compacted graphite iron is usually introduced in a single addition below the surface of the molten iron in a foundry ladle. The magnesium alloy is frequently held in a plunging bell that is immersed below the surface of the molten iron batch or it may be placed in the bottom of the ladle and covered with scrap in a sandwich technique or positioned in a submerged reaction chamber positioned in the gating system of a mold. Some form of constraint is customarily employed to prevent the high silicon-iron-magnesium alloys from floating on the surface of the molten iron bath.

Periodic additions of alloys having a high level of silicon to a bath of molten cast iron are not practical in existing foundry practices. Such alloys carry in substantial quantities of silicon with resulting increase in silicon concentration which soon exceeds an acceptable level in the ductile or compacted graphite irons.

In accordance with the present invention, the molten cast iron to be treated with magnesium may be held in a furnace or foundry ladle while the alloy is periodically added to the molten iron over an extended period of time as compared to conventional foundry practices. The alloy may be judiciously added periodically in predetermined amounts to establish and maintain the desired chemical composition of the melt at a given temperature. The periodic addition of the alloy can also be timed to make-up for such magnesium as may be vaporized from the melt during the holding period of time. If desired, the melt may be desulfurized which is of advantage in those cases where the molten cast iron has a relatively high sulfur content which may inhibit nodulation or compaction of the carbon. When treated metal is tapped from a molten bath, an additional quantity of molten cast iron to be magnesium treated may be added to the bath to provide a semi-continuous process or the magnesium alloy may be added to a flowing stream of molten cast iron to establish a continuous treatment process. Another advantage of the processes of the invention is that it provides a ready supply of molten ductile or compacted graphite cast irons and it reduces the handling of materials in the foundry.

These advantageous processes are made possible for the first time by using an alloy which is predominately iron and has a low silicon and low magnesium content as the essential elements thereof. When this alloy is added to molten cast iron smoke fumes or flaring is minimal. The recovery of magnesium in the molten cast iron is high and may range up to about 65% percent by weight and more of the available magnesium in the alloy added to the melt. There is no significant fluctuation in the silicon content of the treated molten iron caused by addition of the alloy. Since the alloy may be periodically added to the holding vessel, desulfurizing action and treatment to produce ductile and compacted graphite cast irons may be combined in a single vessel and in a single operation.

Best results are achieved in accordance with the present invention when the density of the alloy approached and preferably equals or exceeds the density of the molten iron to be treated. In such case the alloy does not tend to float on the surface of the melt, and it may be readily circulated through the melt under gentle agitation.

The alloy of this invention may be produced as described in a copending application Ser. No. 362,866 filed Mar. 29, 1982. The alloy there described comprises by weight from about 0.1 to about 10% silicon, about 0.05 to about 2.0% cerium and/or one or more other rare earth elements, about 0.5 to about 4.0% magnesium, about 0.5 to about 6.5% carbon, the balance being iron. Preferably the density of the alloy approaches that of the molten iron to be treated. Best results are achieved when the density of the alloy is greater than that of the molten iron. To this end, the density of the alloy is preferably from about 6.5 to about 7.5 gms/cm$^3$ and comproses by weight from about 1.0 to about 6.0% silicon, about 0.2 to about 2.0% cerium and one or more other rare earth elements, about 0.9 to about 2.0% magnesium, about 3.0 to about 6.0% carbon, the balance being iron. The preferred rare earth element is cerium. While the cerium is of advantage for its desirable nucleating and nodulizing effects in the molten cast iron to be treated, the cerium may be eliminated in accordance with this invention. For example, the alloy may comprise by weight from about 1.0 to about 6.0% silicon, about 0.5 to about 2.0% magnesium, about 3.0 to about 6.0% carbon, the balance being iron and for best results the density of the alloy is from about 6.5 to about 7.5 gms/cm$^3$. The alloys utilized in accordance with this invention may contain small amounts of other elements such as calcium, barium or strontium and will contain trace elements customarily present in the raw materials used in producing the alloys. In all cases, the alloy is predominately iron which contains as essential elements the above specified low silicon and low magnesium contents.

As described in more detail in the foregoing pending application, the contents of which are hereby incorporated by reference into this application, the foregoing alloys are prepared in conventional manner with conventional raw materials. It is preferred to hold the reaction vessel under the pressure of an inert gas such as argon at about 50 to 75 p.s.i.g. The raw materials used in preparing the alloys include magnesium, magnesium scrap, magnesium silicide, mischmetal, or one or more rare earth metals per se or cerium or cerium silicides, silicon metal, ferrosilicon, silicon carbide, and ordinary pig iron, iron, or steel scrap may be used. The raw materials in the amounts required to give the input of metal elements within the above specified alloy ranges are placed in a suitable vessel and heated to melt temperature (about 1300° C.). and held preferably under inert gas pressure of 50 to 75 p.s.i.g. until the reaction is complete; which, in the case of a 6,000 gram melt, will only take about 3 minutes at the above specified temperature. The molten metal may be cast in conventional manner to provide rapid solidification as in a chill mold technique. Preferably the amount of carbon in the alloy at a given temperature is adjusted to keep the molten iron-magnesium at carbon saturation which in general occurs within the specified range of carbon in the alloy.

Because the magnesium in the alloys is retained as a dispersion of magnesium, the interaction between the magnesium in the alloy and the molten cast iron being treated takes place at a multitude of locations which tends to reduce pyrotechnics and enhance recovery of magnesium in the treated iron. The alloy may be introduced into the molten cast iron to be treated under pressure when in molten form or it may be used in solid particulate form or as bars, rods, ingots and the like depending on the foundry operation at hand.

The following series of examples illustrate the high recovery of magnesium and the compacting and nodulizing effects of the alloy on carbon in the treated cast iron achieved with the low silicon, low magnesium iron alloy used in the process of the present invention. A recovery in the treated molten iron of at least 35% by weight of the magnesium available in the alloy added to molten iron is achieved in accordance with the present invention as compared to a recovery of only about 25% by weight of magnesium recovered from conventional alloys.

The procedure set forth above was used in preparing the alloys of Table I below:

TABLE I

| Chemical Analyses of Alloys Used | | | | |
|---|---|---|---|---|
| | Elemental % By Weight | | | |
| Alloy | Mg | Ce | C | Si |
| Run 192 | 0.70 | 0.52 | 3.62 | 4.28 |
| Run 193 | 1.12 | 0.50 | 3.58 | 4.08 |
| Run 194 | 1.50 | 0.60 | 3.50 | 4.34 |
| Run 195 | 1.16 | — | 3.50 | 3.60 |
| Run 196 | 1.23 | — | 3.55 | 3.50 |

The percent of the essential elements in the alloys of Table I are by weight of the alloy, the balance being iron. The alloys of Table I were used in treating three different heats of cast iron analyzed to have the percent by weight of the elements shown in Table II below, the balance being iron.

TABLE II

| Chemical Analyses of Base Irons | | | | |
|---|---|---|---|---|
| | Elemental % By Weight | | | |
| Heat | C | Si | Mn | S |
| J 755 | 3.51 | 1.96 | 0.53 | 0.010 |
| J 756 | 3.73 | 1.96 | 0.54 | 0.008 |
| J 762 | 3.75 | 1.33 | 0.55 | 0.009 |

The treatment of the cast irons of Table II with the alloys of Table I was carried out in these Examples by pouring the molten cast iron at a temperature of 1525° C. over a preweighed quantity of alloy lying on the bottom of a crucible preheated to 1110° C. The weight of alloy used in treating the molten cast iron was, for each alloy, calculated to provide the percent input of magnesium and cerium based on the weight of molten cast iron to be treated as shown in Table III. After reaction and when the temperature of the molten iron dropped to 1350° C., a foundry grade 75% ferrosilicon was stirred into the bath as a post inoculant calculated to increase the silicon content of the treated iron to about 2.5% by weight. The treated molten iron at the specified input by weight of magnesium and cerium contained the percent by weight of the elements shown in Table III, the balance being iron. The specified percent by weight recovery of magnesium and cerium is also shown in Table III.

TABLE III

| Heat | Alloy Used | Input % Mg Added | Input % Ce Added | Treated Iron Analysis C % | Si % | Mg % | Ce % | % Mg Rec. | % Ce Rec. |
|---|---|---|---|---|---|---|---|---|---|
| J755-2 | 194 | 0.068 | 0.027 | 3.45 | 2.54 | 0.028 | 0.022 | 41 | 81 |
| J755-3 | 196 | 0.029 | — | 3.50 | 2.42 | 0.017 | <0.002 | 59 | — |
| J755-4 | 192 | 0.043 | 0.032 | 3.46 | 2.57 | 0.028 | 0.023 | 65 | 72 |
| J755-6 | 195 | 0.043 | — | 3.37 | 2.51 | 0.028 | <0.002 | 65 | — |
| J756-1 | 193 | 0.028 | 0.012 | 3.65 | 2.54 | 0.014 | 0.004 | 50 | 33 |
| J756-2 | 192 | 0.057 | 0.042 | 3.20 | 2.62 | 0.037 | 0.038 | 65 | 90 |
| J756-3 | 194 | 0.051 | 0.020 | 3.57 | 2.54 | 0.018 | 0.014 | 35 | 70 |
| J756-4 | 193 | 0.057 | 0.025 | 3.60 | 2.56 | 0.028 | 0.025 | 49 | 100 |
| J756-5 | 196 | 0.057 | — | 3.59 | 2.54 | 0.035 | <0.002 | 61 | — |
| J756-6 | 196 | 0.043 | — | 3.39 | 2.48 | 0.024 | 0.002 | 56 | — |
| J762-4 | 195 | 0.028 | — | 3.59 | 2.41 | 0.016 | <0.002 | 57 | — |
| J762-5 | 192 | 0.028 | 0.021 | 3.35 | 2.52 | 0.018 | 0.018 | 64 | 86 |
| J762-6 | 193 | 0.043 | 0.019 | 3.43 | 2.51 | 0.020 | 0.014 | 47 | 74 |

Specimen castings with fins having thicknesses of 0.6 cm and 1.9 cm were poured from each of the treated cast irons in Table III for analysis. The fins were cut from the castings, polished and subjected to a quantitative metallographic analysis for carbon nodularity percent in each of the 0.6 cm and 1.9 cm fins and for the numbers of the graphite nodules per $mm^2$ in each fin. These results are in Table IV below:

TABLE IV

| Heat | Alloy Used | Metallographic Analysis % Nodularity 0.6 cm/1.9 cm | Nodules/$mm^2$ 0.6 cm/1.9 cm |
|---|---|---|---|
| J755-2 | 194 | 91/92 | 380/165 |
| J755-3 | 196 | 54/50 | 237/149 |
| J755-4 | 192 | 92/81 | 394/128 |
| J755-6 | 195 | 83/76 | 299/188 |
| J756-1 | 193 | 47/35 | 210/109 |
| J756-2 | 192 | 95/90 | 356/173 |
| J756-3 | 194 | 63/57 | 223/155 |
| J756-4 | 193 | 91/89 | 357/189 |
| J756-5 | 196 | 90/85 | 285/209 |
| J756-6 | 196 | 62/62 | 250/172 |
| J762-4 | 195 | 55/34 | 248/108 |
| J762-5 | 192 | 62/52 | 227/142 |
| J762-6 | 193 | 76/58 | 310/143 |

The following examples illustrate the low recovery in molten cast iron from conventional ferrosilicon alloys containing about 5% and more magnesium by weight.

A conventional alloy analyzed to contain by weight 6.05% magnesium, 1.13% cerium, 0.95% calcium, 0.58% aluminum, 43.7% silicon and balance iron with customary impurities was used to treat the molten cast iron of Heat J762 of Table II. The treatment was carried out in the same manner described above for treating the iron with the alloys of Table I of the present invention to include the post inoculation as described. The results are given in Table V.

The treated molten iron at the specified input by weight of magnesium and cerium contained the percent by weight of the elements shown in Table V, the balance being iron. The specified percent by weight recovery of magnesium and cerium is also shown in Table V:

TABLE V

| Heat | Input % Mg Added | Treated Iron Analysis C | Si | Mg | Ce | % Mg Recovered |
|---|---|---|---|---|---|---|
| J762-1 | 0.050 | 3.64 | 2.08 | 0.014 | 0.006 | 28 |
| J762-2 | 0.075 | 3.49 | 2.29 | 0.019 | 0.013 | 25 |
| J762-3 | 0.100 | 3.60 | 2.43 | 0.022 | 0.015 | 22 |

The polished fins of specimen castings of the treated iron of Table V having thicknesses of 0.6 cm and 1.9 cm were subjected to quantitative metallographic analysis as described above for Table IV with the results given below in Table VI:

TABLE VI

| Heat | % Nodularity 0.6 cm/1.9 cm | Nodules/$mm^2$ 0.6 cm/1.9 cm |
|---|---|---|
| J762-1 | 62/45 | 248/131 |
| J762-2 | 78/65 | 315/146 |
| J762-3 | 88/85 | 326/158 |

As shown in Table V, only a maximum of 28% by weight of the magnesium available in the conventional alloy was recovered in the molten cast iron as compared to a minimum of 35% by weight of magnesium recovered with the alloy of the present invention. The treatment of the iron in both cases was carried out in the same manner.

The following example further illustrates the enhanced magnesium recovery of the alloys compared to a magnesium-ferrosilicon alloy, and the efficacy of the alloys in producing ductile iron. The amounts of essential elements in the alloys tested are shown in Table VII.

TABLE VII

| Alloy | Elemental % by Weight Mg | Ce | C | Si |
|---|---|---|---|---|
| Run 13 | 1.02 | — | 4.68 | 1.05 |
| Run 15 | 0.86 | 0.53 | 4.40 | 1.06 |
| 5% MgFeSi Alloy (Lot 57441) | 4.99 | 0.58 | — | 43.6 |

A molten base iron was poured at 1525° C. directly over the selected alloy which was lying on the bottom of a clay graphite crucible that had been pre-heated to 1100° C. The base iron used for the treatment in which the magnesium ferrosilicon alloy was used was analyzed as containing 3.98% C, 0.73% Si, and 0.016% S by weight with the balance iron and other trace elements. The base iron used for the treatments in which the said alloys were used was analyzed as containing 3.93% C, 1.56% Si, and 0.017% S with the balance being iron and other trace elements. The temperature of each bath was monitored until it dropped at 1350° C., at which time 0.5% Si, as contained in a foundry grade 75% FeSi, was added as a post inoculant.

The treated molten iron at the specified input by weight of magnesium contained the percent by weight elements as shown in Table VIII.

TABLE VIII

| Heat | Alloy Used | % Mg Input | Treated Iron Analysis % C | % Si | % Mg | % Mg Recovered |
|---|---|---|---|---|---|---|
| J342-2 | Lot 57441 | 0.12 | 3.72 | 2.29 | 0.048 | 40 |
| J342-4 | Run 13 | 0.06 | 3.62 | 2.04 | 0.047 | 78 |
| J342-5 | Run 15 | 0.05 | 3.63 | 1.97 | 0.034 | 68 |

Specimen castings with fins having 0.6 cm and 1.0 cm thicknesses were poured from each of the treated irons in Table VIII when their bath temperatures had dropped to 1325° C. The fins were cut from the specimens, polished, and subjected to a quantitative metallographic analysis for carbon nodularity percent and nodule count per unit area. These results are given in Table IX below.

TABLE IX

| Heat | % Nodularity 0.6 cm/1.0 cm | Nodules/mm$^2$ 0.6 cm/1.0 cm |
|---|---|---|
| J342-2 | 85/86 | 278/263 |
| J342-4 | 80/80 | 172/160 |
| J342-5 | 91/89 | 346/407 |

As shown in Table VIII, the recoveries of magnesium from the alloys of the present invention were 68% or higher compared to a magnesium recovery of 40% for the conventional magnesium ferrosilicon alloy. The quantitative metallographic evaluations indicated that the percentages of nodularity varied from 80 to 91% for the alloys of the present invention compared to 85% for irons treated with the conventional alloy.

The low amount of silicon recovered in treated molten cast iron from the alloys of the present invention is illustrated in the following Example.

Thirty four kilograms of molten cast iron containing 3.6% carbon, 2.3% silicon and 0.016% sulfur by weight and balance of iron was held at a temperature of 1500° C. in a magnesia lined induction furnace. A partial atmosphere of argon gas was supplied above the melt to minimize oxidation losses. An alloy comprising by weight 4.80% silicon, 1.68% magnesium, 3.44% carbon and balance iron with the usual impurities was added through the graphite furnace cover directly into the bath. The percent input of magnesium from the alloy based on weight of molten iron was 0.07%. Samples were periodically taken from the melt and analyzed for the percent magnesium by weight in the molten iron as shown in Table X below.

TABLE X

| Magnesium Analysis Time (min:sec) | % Mg |
|---|---|
| 0:33 | 0.043 |
| 1:10 | 0.039 |
| 1:45 | 0.034 |
| 2:10 | 0.033 |
| 3:03 | 0.031 |
| 4:14 | 0.029 |
| 5:30 | 0.025 |
| 10:00 | 0.019 |

After thirteen minutes a sample of the molten cast iron contained 3.5% carbon, 2.4% silicon and 0.007% sulfur by weight. It will be noted that during the thirteen minutes holding period, the silicon content in the treated cast iron had only increased from 2.3% to 2.4% by weight which is a very insignificant amount. The sulfur in the molten treated iron decreased from 0.016% to 0.007% showing the desulfurization effect of the alloy. The magnesium content in the treated molten cast iron slowly decreased due to vaporization from the bath surface which is to be expected. But, in accordance with the present invention, additional quantities of alloy may be periodically added to establish the desired level in the molten iron without increasing the silicon content to an unacceptable level.

Conventional foundry apparatus may be used in carrying out the processes of the present invention. Some preferred types of apparatus are illustrated in the drawings in which.

Figure 1:
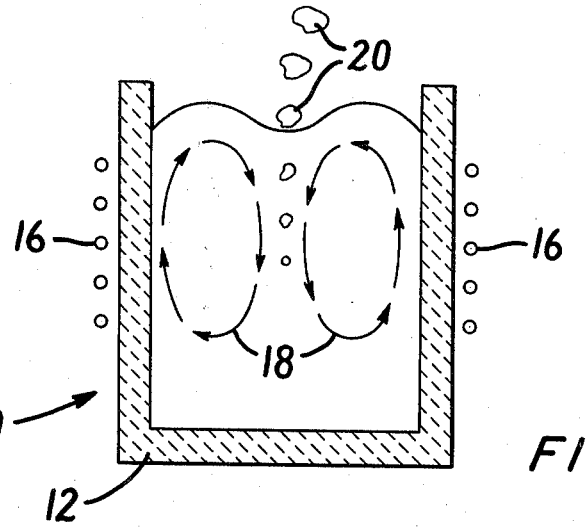
FIG. 1 illustrates a foundry ladle in section equipped with an electric induction stirring coil which may be used as a holding vessel.

Turning now to FIG. 1, the foundry ladle 10 is conventionally lined with a suitable refractory 12 which may be an alumina, silica, graphite or magnesia type refractory with or without an exterior metal casing. The exterior of the ladle is provided with a conventional electric induction stirring coil 16, preferably operated in known manner to cause the molten cast iron therein to circulate and flow from opposite sides of the bath so that the molten iron flows downwardly in the middle of the bath as illustrated by the arrows 18. Pieces 20 of alloy of the present invention of the composition specified hereinabove are slowly added manually or by means of a mechanical feeder (not shown). Circulation of the molten cast iron will pull the alloy underneath the surface of the bath for treating the molten iron to produce ductile or compacted graphite cast iron depending on the composition of the molten iron and input of magnesium or magnesium-cerium alloy. Depending on the particular foundry operation, the treated cast iron may be held in the ladle over an extended period of time and the desired chemical composition of the molten cast iron may be established and maintained by periodically adding additional alloy as deemed necessary. A portion of the treated iron may be poured off and cast and fresh molten base iron may be added from the furnace to replenish the supply accompanied or followed by the addition of more alloy for the desired treatment. Ladle 10 may be gimbaled in known manner (not shown) and tilted for pouring by known foundry mechanical devices.

If desired, the ladle 10 may be equipped with conventional heating elements (not shown) to maintain the selected temperature for treatment and in place of the induction coil 16, the ladle may be provided with a conventional mechanical or pneumatic stirrer (not shown) for gentle agitation. Operation of the induction coil 16 may be changed in known manner to cause the metal in the bath to flow in opposite directions to arrows 18 and move upwardly in the middle of the bath and downwardly on opposite sides. In such case the pieces of alloy 20 are added at opposite sides of the ladle instead of in the middle as shown in the drawing.

Desulfurization of the molten cast iron may also be carried out in the holding ladle before and during treatment to produce ductile or compacted graphite cast irons. For example, if the molten cast iron contains sulfur on the order of 0.1% by weight this may be reduced in the holding ladle down to about 0.01% by weight or less by addition of alloy during the holding period of time.

The molten bath of cast iron in a furnace vessel (not shown) in which it is produced may also be used as a holding vessel and the alloy of the present invention may be added to the furnace bath to treat the molten cast iron as described above for ladle 10.

Holding ladle 10 may be provided with a cover (not shown) and the molten cast iron and alloy may be fed into the ladle through the cover. If desired for reduction of oxidation, a partial or complete atmosphere of an inert gas such as argon may be established in known manner in the space between the cover and surface of the bath. The ladle may be equipped with a bottom tap hole (not shown) for withdrawal of treated molten metal. The bottom tap hole may be opened and closed by a plug (not shown) operated in known manner by mechanical means.

While desirable results are achieved by using pieces of alloy from one to two inches in greatest dimension, the alloy may be more finely divided even down to a rough powder or the alloy may be melted and fed into the holding vessel in molten form with the bath under pressure of an inert gas to treat the molten cast iron. Rods, bars or ingots of the alloy may be used for treating the molten cast iron.

Figure 2:
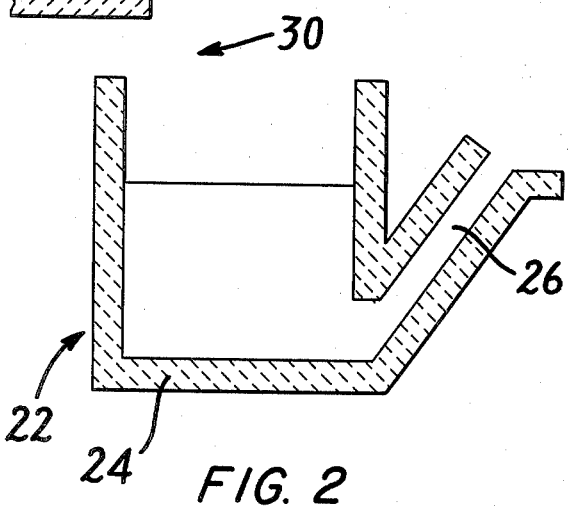
FIG. 2 illustrates another form of foundry ladle in section which may be used as a holding vessel in a batch or continuous operation.
Figure 3:
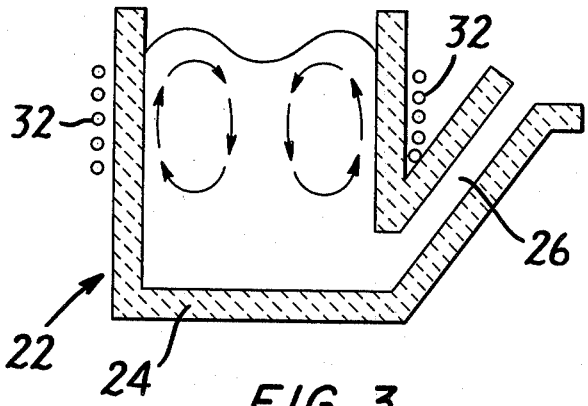
FIG. 3 illustrates the ladle of FIG. 2 equipped with an electric induction stirring coil.

The modified forms of ladle 10 shown in FIGS. 2 and 3 include a ladle 22 of usual refractory 24 lining with a tea-pot outlet spout 26 for pouring. In this case, a stream of molten cast iron from a melting source such as a cupola (not shown) is fed to the ladle at 28. The alloy of the present invention is supplied into the stream of molten cast iron at 30. The flow of the metal stream is used to carry the alloy beneath the surface of the bath where the alloy reacts with the molten cast iron and dissolves. FIG. 3 illustrates the ladle of FIG. 2 provided with an electric induction stirring coil 32 which may be used to assist in mixing the alloy and molten cast iron as previously described for the induction coil of FIG. 1. The induction coil may also be used to provide heat to the bath as desired for foundry operation.

Figure 4:
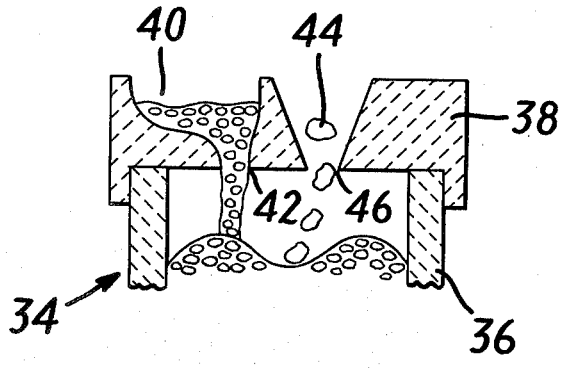
FIG. 4 illustrates a foundry ladle equipped with a cover modification.

The ladle 34 of FIG. 4 has the usual refractory 36 lining and is provided with a cover 38 having a reservoir 40 and inlet port 42 for supplying molten cast iron into the ladle. The alloy 44 of the present invention is manually or mechanically fed into the ladle through a separate inlet feed port 46. In this case the molten cast iron is fed at a controlled rate and the alloy is supplied at a controlled rate separated from the iron stream.

Figure 5:
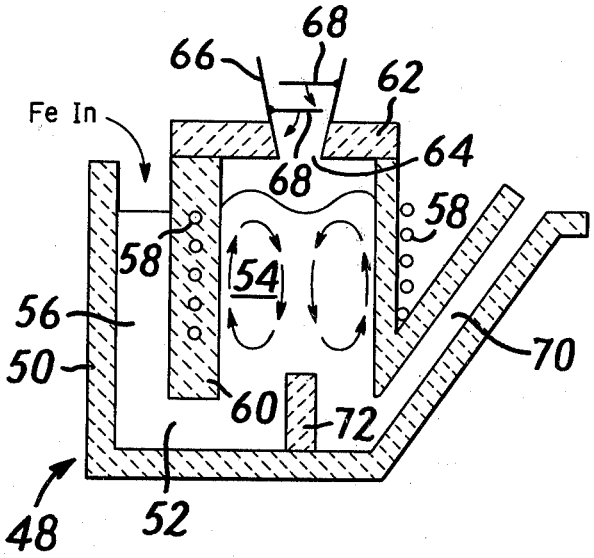
FIG. 5 illustrates a holding vessel with a modified form of cover.

Ladle 48 of FIG. 5 has the customary refractory 50 lining. An inlet port 52 for molten cast iron is positioned at one side of the bottom of the mixing chamber 54. The inlet port 52 is in open communication with an enclosed channel 56 that extends up to the top at one side of chamber 54. An electric induction coil 58 is positioned in the common wall 60 between channel 56 and chamber 54. The remainder of the coil is wrapped around the exterior of the wall of chamber 54. Mixing chamber 54 has a cover 62 with an inlet port 64 which is fitted with a hopper 66 having a plurality of staggered flop gate baffles 68 therein. The bottom of chamber 54 has a tea-pot pouring spout 70. A baffle 72 in the middle of the bottom of chamber 54 extends up above the top of inlet port 52 and above the top of exit to spout 70.

Molten cast iron is fed to mixing chamber 54 through channel 56 and the alloy of the present invention is supplied to the mixing chamber through the staggered flop gate baffles of hopper 66. Induction coil 58 mixes the molten metal and alloy as described in connection with FIG. 1. Periodically the treated metal is poured into casting molds as by tilting the unit in known manner. The baffle 72 prevents direct communication of molten cast iron between inlet port 52 and the exit of the tea-pot pouring spout 70. Make up molten cast iron may be added after each incremental pouring of treated iron and alloy is also added to maintain the selected chemical composition for treated iron. If desired, the top of spout 70 may be positioned further down below the top of chamber 54 and below the top of channel 56. In such case, molten metal will automatically pour out of the spout whenever the level of molten iron in chamber 54 and channel 56 is above the top of the spout.

Figure 6:
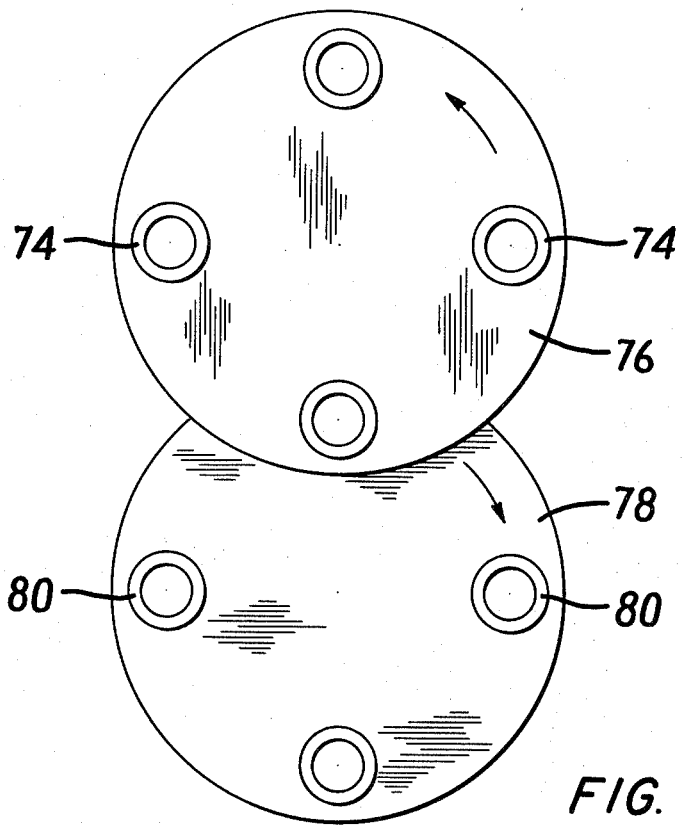
FIG. 6 illustrates one form of an automatic pouring apparatus for mold casting.

FIG. 6 illustrates another method for the casting of treated molten cast iron. In this case a plurality of conventional foundry holding vessels 74 are carried in a rotating support 76 which is positioned above a second rotating support 78 that carries a plurality of casting molds 80. Suitable drive means (not shown) rotate the supports in separate circular paths in sequence to bring the casting molds into position below the holding vessesl 74. The holding vessels have a tap hole in the bottom opened and closed by a plug actuated by mechanical means to pour molten treated iron into molds 80. If desired, the ladles may be gimbaled and tilted in known manner to pour the molten treated iron into the molds.

A furnace vessel (not shown) such as a cupola or a holding ladle containing a supply of molten iron containing carbon (ordinary cast iron) is positioned to pour the molten iron into the holding vessels 74. The alloy of the present invention which is predominately iron containing as essential ingredients a low silicon and a low magnesium content as specified hereinabove is added to the molten iron in the holding vessels 74 and treatment of the iron with alloy is carried out as the holding vessels move toward their position to pour alloy treated molten iron into the casting molds.

Best results are achieved in this process by using the iron alloy of the present invention which has a density equal to and preferably greater than the density of the molten iron to be treated and which alloy contains from about 1.0% to about 6.0% silicon by weight and from about 0.5 to about 2.0% magnesium by weight as essential elements.

In the preferred operation, the holding vessels 74 have a supply of treated molten iron adequate to fill a plurality of molds 80. In such case the pouring vessels are held stationary while a plurality of molds are moved one at a time into stationary position below a first one of the holding vessels. When the supply of treated molten iron in the first one of the holding vessels is low, the next holding vessel in line is moved into the stationary position to pour treated molten iron into the next plurality of molds. Meanwhile, the first one of the holding vessels receives a new supply of molten iron and alloy.

If desired, the supply of treated molten iron in each holding vessel may be limited to that required to fill a single casting mold. While the drawing illustrates moving the pouring vessels 74 and molds 80 in circular paths, the vessels and molds may move along any selected path other than circular with the selected paths arranged to intersect for transfer of treated molten iron from the vessels to the molds. In one example, the paths are oblong and treated molten metal is transferred into the molds while the pouring vessel and molds continue to move along a first straight intersecting portion of the oblong paths. In such case there is no need to hold the vessels and molds in stationary position for filling the mold. A resupply of metal to the holding vessels is obtained in similar manner while the vessels move along the second straight portion of their oblong path and a separate supply container moves along the same path above the vessels.

In the preferred operation untreated molten iron and alloy are supplied to the holding vessels in any desired sequence from selected sources of supply and reaction between the alloy and molten iron takes place before the vessel reaches its pouring position above the mold. If desired, alloy may be added to untreated molten iron in a furnace vessel or holding ladle to carry out the treatment reaction between the alloy and molten iron at the source of supply in the furnace vessel or holding ladle. The magnesium treated molten iron is supplied to the holding vessels 74. Alloy can also be added to the treated iron in the holding vessel for final adjustment to obtain a selected chemical composition or the untreated molten iron may be partially treated at the source of supply in the furnace or holding ladle and treatment with alloy completed in the holding vessels 74.

In a modified process, rotating support 76 and holding vessels 74 are eliminated and the casting molds 80 are moved into stationary position below a furnace vessel or a holding ladle such as one of those illustrated in FIGS. 1 through 5. The molds are filled in sequence directly from the supply of treated metal in the furnace or holding ladle.

Figure 7:
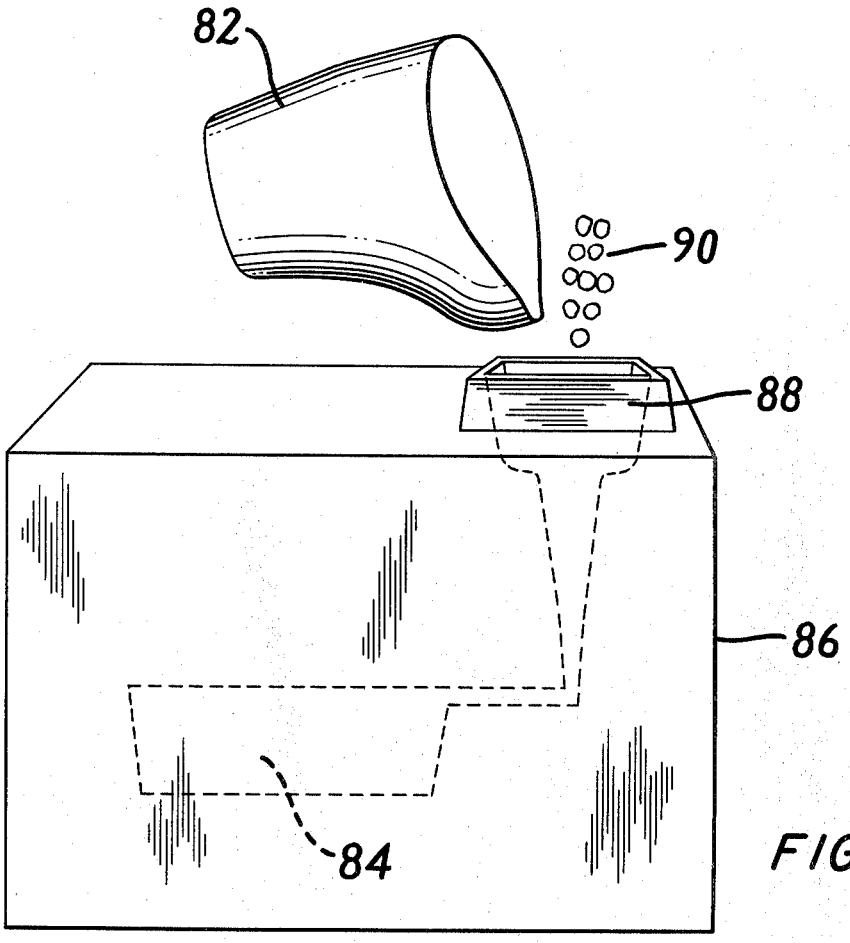
FIG. 7 illustrates one form of apparatus for introducing the alloy of the present invention into a flowing stream of molten cast iron in a continuous or batch operation.

In FIG. 7 a conventional refractory holding ladle 82 is employed for pouring molten iron into the cavity 84 of a casting mold 86. The sprue of the mold has a small reservoir portion 88 which assists in receiving the molten cast iron. In this case, pieces of alloy 90 of the present invention are fed into the flowing stream of metal as it enters reservoir 88 and the flow of the stream carries the alloy down into the mold for treating the molten iron to produce ductile or compacted graphite cast iron depending on the input of magnesium into the molten cast iron.

It will now be understood that these processes are made possible by the essential characteristics of the alloy of the present invention comprising a predominately iron alloy with low silicon and low magnesium content and density which approaches the density and for best results is equal to or greater than the density of the molten cast iron to be treated.

It will also be understood that the preferred embodiments of the preferred form of the invention herein chosen for the purpose of illustration are intended to cover all changes and modifications which do not depart from the spirit and scope of the invention.

What is claimed is:

1. In the method of producing ductile or compacted graphite cast irons, the improvement which comprises the steps of holding molten iron that contains carbon in a vessel, adding to the molten iron bath an alloy predominately of iron which contains from about 1.0 to about 6.0% silicon by weight and from about 0.5 to about 2.0% magnesium by weight as the essential elements, continuing to hold said molten iron containing said alloy in said vessel until reaction between the magnesium and iron has taken place and thereafter in a second step adding more of said alloy to said molten iron to establish the desired chemical composition thereof.

2. The method of claim 1 wherein the alloy has a density greater than that of the molten iron.

3. The method of claim 1 wherein the alloy has a density between about 6.5 to about 7.5 gms/cm$^3$.

4. The method of claim 1 wherein the alloy predominately of iron also contains cerium in an amount not over about 2.0% by weight.

5. The method of claim 1 wherein the alloy predominately of iron also contains one or more rare earth elements in an amount not over about 2.0% by weight.

6. The method of claim 1 wherein the alloy predominately of iron contains by weight from about 0.1 to about 10.0% silicon, about 0.05 to about 2.0% rare earth elements, about 0.5 to about 4.0% magnesium and about 0.5 to about 6.5% carbon.

7. The method of claim 1 wherein the alloy comprises by weight from about 1.0 to about 6.0% silicon, up to about 2.0% cerium, about 0.5 to about 2.0% magnesium with the balance being iron.

8. The method of claim 1 wherein the holding vessel is the vessel of a furnace.

9. In the method of producing ductile or compacted graphite cast irons, the improvement which comprises the steps of holding molten iron that contains carbon in a vessel, treating said molten iron by adding to the molten iron bath a predominately iron alloy which as essential elements contains from about 0.1 to about 10.0% silicon by weight and from about 0.5 to about 4.0% magnesium by weight, continuing to hold said molten iron in said vessel until the magnesium from said alloy has increased the magnesium content of said treated molten iron and thereafter adding more untreated molten iron that contains carbon to said vessel along with more of said alloy to increase the magnesium content of said untreated added iron.

10. In the method of producing ductile or compacted graphite cast irons, the improvement which comprises the steps of holding molten iron that contains carbon in a vessel, adding to the molten iron bath an alloy predominately of iron which contains as essential elements thereof from about 0.1 to about 10.0% silicon by weight and from about 0.5 to about 4.0% magnesium by weight, reacting the magnesium of said alloy with said molten iron to increase the magnesium content of the molten iron to a selected level, continuing to hold said treated molten iron in said vessel until the magnesium content in said treated molten iron falls below the selected level and then adding more of said alloy to said molten iron to increase the magnesium content thereof at least to a selected level.

11. In the method of producing ductile or compacted graphite irons, the improvement which comprises the steps of holding molten iron that contains carbon and sulfur in a vessel, treating the molten iron by adding to the molten iron bath an alloy predominately of iron which contains as essential elements thereof from about 0.1 to about 10.0% silicon by weight and from about 0.5 to about 2.0% magnesium by weight, continuing to hold said treated molten iron in said vessel until the sulfur content in the treated iron is reduced and thereafter adding more of said alloy to the molten iron to increase the magnesium content thereof.

12. In the method of producing ductile or compacted graphite cast irons, the improvement which comprises the steps of holding molten iron that contains carbon in a vessel, agitating the molten iron to establish circulation in a downward flow in the middle of the bath, adding to the surface of the middle of the bath a predominately iron alloy which contains as essential ingredients thereof from about 0.1 to 10.0% silicon by weight and from about 0.5 to 4.0% magnesium by weight whereby the alloy is carried below the surface of the bath by the downward flow of molten iron.

13. The method of claim 12 wherein an electric induction stirring coil provides said agitation of the molten iron.

14. The method of claim 12 wherein the molten iron is agitated to flow upwardly in the middle of the bath and downwardly on opposite sides of the bath and wherein said alloy is added to the molten iron in the downward flow to be carried under the surface of the bath.

15. The method of claim 12 wherein the alloy also contains up to about 2.0% cerium by weight.

16. In the method of producing castings of ductile or compacted graphite cast irons, the improvement which comprises flowing a stream of molten iron containing carbon into a mold and adding to the stream of molten iron as it enters the mold a predominately iron alloy which contains as essential elements thereof from about 0.1 to about 10.0% silicon by weight and from about 0.05 to about 2.0% magnesium by weight whereby the alloy is carried into the mold by the flowing stream of molten iron.

17. In the method of producing ductile or compacted graphite cast irons, the improvement comprising the steps of flowing a stream of molten iron containing carbon into a holding vessel, adding to said stream of molten iron a predominately iron alloy which contains from about 0.1 to about 10.0% silicon by weight and from about 0.5 to about 2.0% magnesium by weight whereby said alloy is carried by the stream of molten iron into the holding vessel and below the surface of the bath established therein.

18. In the method of producing castings of ductile and compacted graphite cast irons, the improvement which comprises supplying molten iron which contains carbon to at least one holding vessel, treating said molten iron by adding to the molten iron bath in the vessel a predominately iron alloy which contains as essential elements thereof from about 0.1 to about 10.0% silicon by weight and from about 0.5 to about 2.0% magnesium by weight, moving a plurality of casting molds in sequence to bring one at a time into position below said vessel to receive treated molten iron from said vessel and adding more untreated molten iron containing carbon into said holding vessel along with more of said alloy in an iron casting operation.

19. The method of claim 18 wherein the plurality of molds are held stationary and the holding vessel is moved into position to supply treated molten iron to the molds.

20. The method of claim 18 wherein the holding vessel is held stationary and the plurality of molds are moved into position to receive treated molten iron from the holding vessel.

21. The method of claim 18 wherein the molten iron bath is agitated to circulate the molten iron downwardly in the middle of the bath and the alloy is added at the surface in the middle of the bath where it can be carried below the surface thereof by the downward flow of metal.

22. The method of claim 18 in which the alloy contains by weight from about 0.1 to about 10.0% silicon, about 0.5 to about 4.0% magnesium, as the essential ingredients in said predominately iron alloy and wherein the alloy has a density from about 6.5 to about 7.5 gms/cm$^3$.

23. The method of claim 22 wherein the alloy includes up to about 2.0% cerium by weight.

24. The method of claim 18 wherein there are a plurality of holding vessels for treating the molten iron with alloy and for supplying treated molten iron to the molds.

25. In the method of producing castings of ductile or compacted graphite cast irons, the improvement which comprises moving a plurality of holding vessels in a first circular path, moving a plurality of casting molds in a second circular path to bring the plurality of molds into position below said plurality of holding vessels to receive treated molten iron therefrom, establishing in said plurality of holding vessels a supply of molten iron containing carbon which has been treated with a predominately iron alloy containing as essential elements thereof by weight from about 0.1 to about 6.0% of silicon and from about 0.5 to about 2.0% magnesium, interrupting the movement of said holding vessels and molds to hold them in stationary position while at least one mold receives treated molten iron from at least one holding vessel, and re-estabishing the supply of treated molten iron in said holding vessels when held in stationary position as required for a casting operation.

26. The method of claim 25 wherein the iron alloy contains as essential elements by weight from about 0.1 to about 10.0% silicon, and from about 0.5 to about 4.0% magnesium.

27. The method of claim 26 wherein said alloy includes up to about 2.0% cerium by weight.

28. The method of claim 25 wherein the untreated molten iron is supplied to said plurality of holding vessels and said alloy is added to the untreated molten iron to establish and re-establish said supply of treated molten iron in said plurality of vessels for transfer to said molds.

29. The method of claim 25 wherein the molten iron is treated with said alloy in one or more separate supply vessels which supply the treated molten iron to said plurality of holding vessels to establish and re-establish the supply of treated molten iron for transfer to said molds.

30. The method of claim 25 wherein additional alloy is added to the treated molten iron in said holding vessels to obtain a selected chemical composition of treated molten iron for transfer to the molds.

31. The method of claim 25 wherein untreated molten iron is partially treated with said alloy in one or more separate supply vessels which supply the partially treated molten iron to said plurality of holding vessels and additional alloy is added to said partially treated molten iron in said holding vessels to complete the treatment of the molten iron therein and establish and re-establish the supply of molten iron for transfer to said molds.

32. The method of claim 25 wherein the predominately iron alloy contains as essential elements by weight from about 3.0 to about 6% silicon, from about 0.5 to about 2.0% magnesium, up to about 2.0% cerium and 3.0 to 6.5% carbon.

33. The method of claim 25 wherein the density of said alloy is from about 6.5 to about 7.5 gms/cm$^3$.

34. The method of claim 25 wherein the plurality of holding vessels and plurality of casting molds are moved in selected intersecting paths that are not circular and treated molten iron is transferred from the vessels to the molds where the selected paths intersect.

35. The method of claim 34 wherein the selected paths are oblong and the treated molten iron is transferred to the molds while the holding vessels and molds are moving along a first straight portion of the oblong path where the paths of the holding vessels and molds intersect and wherein a separate supply container moving along a path that intersects a second straight portion of the oblong path of said holding vessels is employed for establishing and re-establishing the supply of treated molten iron for transfer to said molds.

* * * * *